US009947981B1

(12) United States Patent
Strassner, II et al.

(10) Patent No.: US 9,947,981 B1
(45) Date of Patent: Apr. 17, 2018

(54) WAVEGUIDE MODULE COMPRISING A FIRST PLATE WITH A WAVEGUIDE CHANNEL AND A SECOND PLATE WITH A RAISED PORTION IN WHICH A SEALING LAYER IS FORCED INTO THE WAVEGUIDE CHANNEL BY THE RAISED PORTION

(71) Applicant: National Technology & Engineering Solutions of Sandia, LLC, Albuquerque, NM (US)

(72) Inventors: Bernd H. Strassner, II, Albuquerque, NM (US); Richard Liedtke, Tijeras, NM (US); Jacob Jeremiah McDonald, Albuquerque, NM (US); Matthew Halligan, Albuquerque, NM (US)

(73) Assignee: National Technology & Engineering Solutions of Sandian, LLC, Albuquerque, NM (US)

( * ) Notice: Subject to any disclaimer, the term of this patent is extended or adjusted under 35 U.S.C. 154(b) by 64 days.

(21) Appl. No.: 15/159,377

(22) Filed: May 19, 2016

(51) Int. Cl.
*H01P 3/12* (2006.01)
*H01P 11/00* (2006.01)

(52) U.S. Cl.
CPC ..... *H01P 3/12* (2013.01); *H01P 11/002* (2013.01)

(58) Field of Classification Search
CPC ..... H01P 3/12; H01P 11/002
USPC ..... 333/239
See application file for complete search history.

(56) References Cited

U.S. PATENT DOCUMENTS

| | | | | |
|---|---|---|---|---|
| 3,157,847 | A | 11/1964 | Williams | |
| 3,617,960 | A * | 11/1971 | Lavedan, Jr. | H01P 1/195 333/239 |
| 4,613,839 | A * | 9/1986 | Foglesonger et al. | H01P 11/002 228/174 |
| 5,229,728 | A | 7/1993 | Carvalho et al. | |
| 5,381,596 | A | 1/1995 | Ferro | |
| 6,882,762 | B2 | 4/2005 | Brist et al. | |
| 2007/0257751 | A1 * | 11/2007 | Jarno et al. | H01P 3/12 333/239 |

OTHER PUBLICATIONS

Weiss, Steven J., "Antennas and Beamformer Architectures for Army Platforms", Available at: <<http://ewh.ieee.org/r2/no_virginia/aps/WashingtonSection7_20_2011v3.pdf>>, US Army Research Laboratory, Jul. 20, 2011, 61 Pages.

* cited by examiner

*Primary Examiner* — Benny Lee
(74) *Attorney, Agent, or Firm* — Medley, Behrens & Lewis, LLC

(57) ABSTRACT

The various technologies presented herein relate to utilizing a sealing layer of malleable material to seal gaps, etc., at a joint between edges of a waveguide channel formed in a first plate and a surface of a clamping plate. A compression pad is included in the surface of the clamping plate and is dimensioned such that the upper surface of the pad is less than the area of the waveguide channel opening on the first plate. The sealing layer is placed between the waveguide plate and the clamping plate, and during assembly of the waveguide module, the compression pad deforms a portion of the sealing layer such that it ingresses into the waveguide channel opening. Deformation of the sealing layer results in the gaps, etc., to be filled, improving the operational integrity of the joint.

11 Claims, 6 Drawing Sheets

WAVEGUIDE MODULE COMPRISING A FIRST PLATE WITH A WAVEGUIDE CHANNEL AND A SECOND PLATE WITH A RAISED PORTION IN WHICH A SEALING LAYER IS FORCED INTO THE WAVEGUIDE CHANNEL BY THE RAISED PORTION

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

A waveguide can be utilized to route radio frequency (RF) signals from a source to an antenna array, wherein the waveguide can include numerous power dividers/couplers (e.g., "T" splitters) to properly feed antenna elements with a desired signal (e.g., having a desired signal strength). Conventional waveguides can be formed with tubular structures comprising continuous surfaces of highly conductive material, typically a metal or dielectric, as well as being fabricated from a solid plate(s), such as an aluminum plate.

A tube waveguide can be formed from a plurality of tubes (e.g., metal tubes) which are brazed together to form a desired structure. However, constructing waveguides in such a manner can be labor intensive, design can be limited by a selection of tubes that are commercially available (commercial off-the-shelf (COTS)), problems can be encountered when attempting to ensure a functional joint between tubes, etc. A discontinuity in the waveguide (e.g., at a joint between tubes) can produce a reactive load, inductive or capacitive, depending on the particular character of the discontinuity. Elimination of the discontinuity can be achieved with the waveguide walls being smooth, flat, and straight, which can place considerable manufacturing constraints and considerations upon fabrication of a waveguide fabricated from tubes. Fabricating a waveguide structure from a metal plate can alleviate some of the issues, however, in a plate configuration comprising a machined plate (e.g., into which a waveguide channel has been formed) and a clamping plate, RF leakage can occur at the joint between the waveguide channel and the surface of the clamping plate. Rapid removal techniques (e.g., rapid milling) have been attempted to fabricate waveguides in aluminum plate, however, air gaps between the waveguide plate and the clamping plate have proven to be problematic, especially over larger waveguide constructs, wherein discontinuities can occur in the machines surface, e.g., tooling marks, and further as a function of machining stresses that can build during the rapid material removal.

SUMMARY OF THE INVENTION

The following is a brief summary of subject matter that is described in greater detail herein. This summary is not intended to be limiting as to the scope of the claims.

Various exemplary embodiments presented herein relate to sealing a waveguide channel to facilitate desired electromagnetic modality of a waveguide module. In a conventional module construction, a gap, warping, or other irregularity, can affect integrity of a joint between an edge formed by a waveguide channel and a surface of a clamping plate attached thereto, for example, RF leakage can occur at a joint having poor joint integrity.

Per the various embodiments presented herein, a sealing layer is placed between a first surface of a waveguide plate (having the waveguide channel formed therein) and a surface of a clamping plate. The waveguide channel can have a trough-like configuration which opens to the first surface of the waveguide plate, wherein a perimeter of the opening of the waveguide channel forms an edge at a junction with the first surface. The clamping plate further comprises a compression pad (or raised portion) that is located opposite the waveguide channel. The compression pad can have a width that is less than a width of the opening of the waveguide channel. During attachment/securing of the waveguide plate to the clamping plate, the compression pad causes a portion of the sealing layer material to be deformed and pushed into the waveguide opening, thereby causing the sealing layer to deform around the edge of the waveguide opening, and consequently, fill gaps, irregularities, warping, tooling marks, etc., located at the edge. The sealing layer acts to improve the integrity of the joint compared to that achievable by a conventional approach.

In an embodiment, the sealing layer can be formed from a malleable material (e.g., aluminum, copper, etc.). In another embodiment, the compression pad can be formed from a material that has a degree of resilience (hardness) such that interaction of the compression pad with the sealing layer causes the sealing layer to deform (e.g., around the edge of the waveguide channel) but without a level of deformation that causes the sealing layer to crack, tear, split, etc. The compression pad can be formed from any suitable material, e.g., silicon rubber. The waveguide plate and/or the clamping plate can be formed from any suitable material, e.g., aluminum or other conductive material.

In an embodiment, the compression pad can be located in a pad channel formed in the clamping plate, wherein when the surface of the waveguide plate (which includes the waveguide channel) is placed adjacent to the surface of the clamping plate that includes the pad channel, the pad channel (and the compression pad located therein) is an inverse image (mirror image) of the waveguide channel, wherein the compression pad can be narrower than the waveguide channel. In an embodiment, the pad channel has a depth $D_1$, while the compression pad has a thickness $T_1$, wherein $T_1>D_1$, such that the compression pad has an external surface (upper surface) that is raised above the surface of the clamping plate having the pad channel formed therein.

In another embodiment, rather than using a compression pad located in a pad channel, the clamping plate can be fabricated with a raised portion of material to function in the same manner as the raised surface of the compression pad. In an embodiment, the raised portion of material can be formed by machining a surface of the clamping plate. In another embodiment, the raised portion of material can be formed from a layer of material that is deposited upon the surface of the clamping plate.

In a further embodiment, a plurality of waveguide channels can be formed in the waveguide plate. For example, a first waveguide channel can be fabricated into a first side (upper surface) of the waveguide plate, and a second waveguide channel can be fabricated into a second side (lower surface) of the waveguide plate, wherein the first and second waveguides are respectively sealed by a first clamping plate and first sealing layer, and a second clamping plate and a second sealing layer.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION OF THE INVENTION

Figure 1:
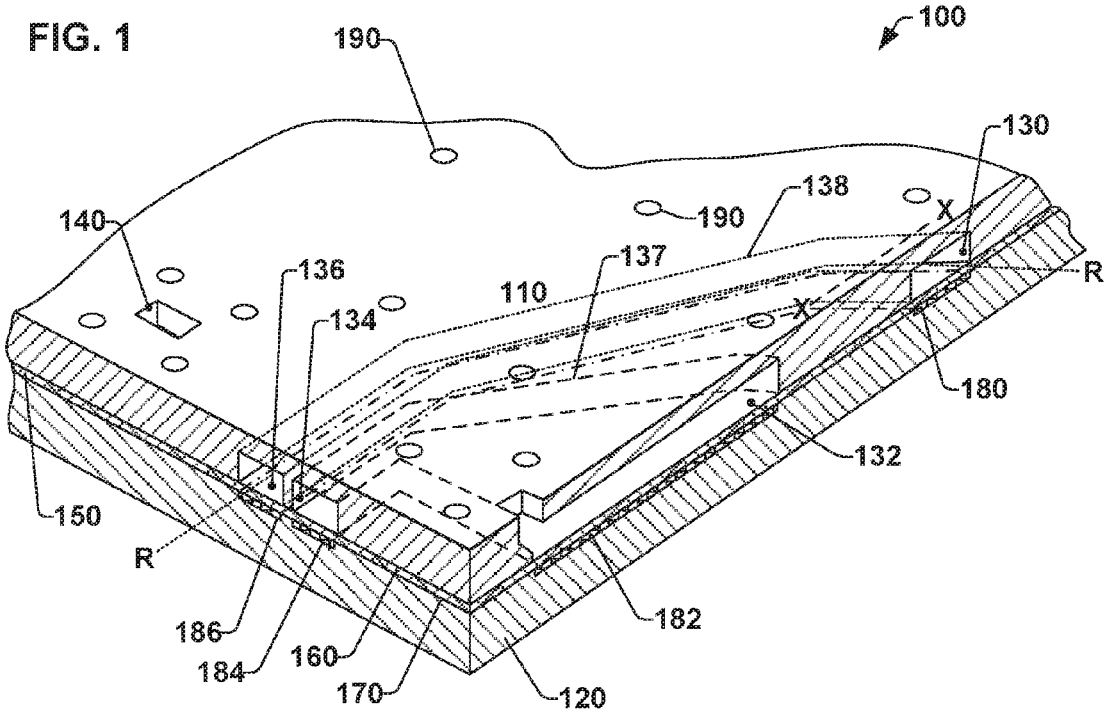
FIG. 1 presents a schematic of a waveguide module comprising a sealing layer and a compression pad, according to an embodiment.

Various technologies pertaining to sealing an edge of a waveguide channel opening to facilitate operation of a waveguide module with a desired electromagnetic modality are now described with reference to the drawings, wherein like reference numerals are used to refer to like elements throughout. In the following description, for purposes of explanation, numerous specific details are set forth in order to provide a thorough understanding of one or more aspects of the invention. It may be evident, however, that such aspect(s) may be practiced without these specific details. In other instances, well-known structures and devices are shown in block diagram form in order to facilitate describing one or more aspects of the invention.

Further, the term "or" is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

The following embodiments present structures and methods for a waveguide module, wherein the waveguide module can comprise a complex network of waveguides that can be easily manufactured, having a low cost, with a high reliability of operation as compared with a conventionally fabricated waveguide. An intricate waveguide configuration can be produced in a plate by any suitable manufacturing process, e.g., computer numerically controlled (CNC) milling, polishing, etc. A sealing layer, comprising a malleable material, is placed between a waveguide plate (having a waveguide channel formed therein) and a clamping plate, wherein the sealing layer is utilized to seal the waveguide channel to create a waveguide manifold formed by the waveguide plate configuration and the clamping plate, thereby enabling the waveguide manifold to support a desired electromagnetic modality. As previously mentioned, in a conventional waveguide module where the sealing layer is absent, air cracks can arise at various places (joints) between the waveguide channel and the clamping plate, leading to possible degradation of one or more waveguide modes that are desired to propagate along the waveguide.

FIG. 1 presents a waveguide module 100 configured to minimize and/or eliminate RF leakage during operation of the waveguide module 100. As shown, the waveguide module 100 comprises a waveguide plate 110 and clamping plate 120. The waveguide plate 110 is also referred to herein as a first plate, and the clamping plate 120 is also referred to herein as a second plate. The waveguide plate 110 has one or more waveguide channel openings 130, 132, 134, 136 (plus other features and tunnels forming a waveguide manifold(s)) formed therein, and location of the clamping plate 120 against the waveguide plate 110 facilitates formation of waveguide manifolds from one or more waveguide channels formed between the waveguide channel openings 130, 132, 134 and 136. As shown in FIG. 1, the waveguide manifolds can be formed in the waveguide plate 110 such that a waveguide opening is located in a sidewall of the waveguide plate 110 (e.g., the waveguide channel opening 132) and further, a waveguide opening is located in the top/upper surface 140 (or bottom/lower surface, not shown). For understanding of the various embodiments presented herein, the waveguide channel opening 132 is illustrated as being connected to the waveguide channel opening 134 by a waveguide channel 137 (per the broken hidden detail line), wherein the waveguide channel 137 forms a path (e.g., between R-R) through the waveguide plate 110 between the waveguide channel opening 132 and the waveguide channel opening 134. It is to be noted that in operation a waveguide channel may not have a configuration similar to that of waveguide channel 137, the path of waveguide channel 137 is simply for illustration and understanding. A waveguide channel 138 is similarly illustrated connecting the waveguide opening 130 with the waveguide opening 136.

A sealing layer 150 is located between (e.g., sandwiched) a bottom surface 160 (first surface) of the waveguide plate 110 and an upper surface 170 (second surface) of the clamping plate 120. A compression pad (e.g., any of compression pads 180, 182, 184, and 186) is located opposite each respective opening 130, 132, 134, and 136 of each waveguide channel in the waveguide plate 110. As the waveguide plate 110, the sealing layer 150, and the clamping plate 120 are assembled (e.g., via a fastener secured in a through-hole 190, not shown), each respective compression pad 180, 182, 184, and 186 applies pressure to a respective portion of the sealing layer 150 causing the sealing layer 150 to deform and seal gaps, discontinuities, etc., that might be between the waveguide channels 137 and 138 in the bottom surface 160 of the waveguide plate 110 and the upper surface 170 of the clamping plate 120, e.g., along a respective length of the waveguide channel 137 or 138, as further described below.

Figure 2A:
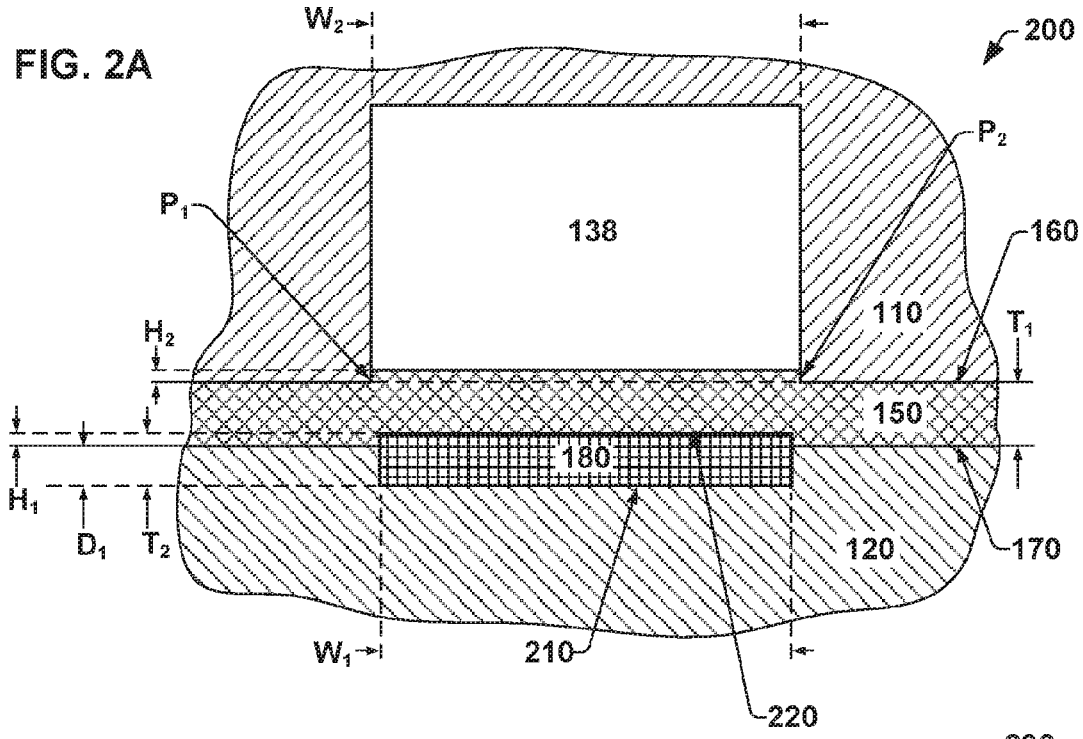
FIG. 2A presents a sectional view through a waveguide sealed by a sealing layer in conjunction with a compression pad, according to an embodiment.

FIG. 2A is a section 200 of the waveguide module 100 taken at X-X of FIG. 1, through the waveguide channel 138. As shown, the waveguide plate 110 is located upon the clamping plate 120, with the sealing layer 150 located therebetween, and the compression pad 180 is located opposite the waveguide channel 138. The sealing layer 150 has a thickness $T_1$. The compression pad 180 is located in a channel 210 (recess, pad channel) formed in the upper surface 170 of the clamping plate 120, wherein the compression pad 180 has a width $W_1$ that is narrower than a width $W_2$ of the waveguide channel 138. The channel 210 can be an inverse image (mirror image) of the waveguide channel 138, wherein the channel 210 (and the compression pad 180 located therein) is configured to follow the path (e.g., between R-R as shown in FIG. 1) defined by the waveguide channel 138 in the waveguide plate 110, although, based upon the difference between $W_1$ and $W_2$, the channel 210 may be narrower (depending upon size and tolerancing of the compression pad 180). Further, an upper surface 220 of the compression pad 180 is raised (higher) with respect to a position of the upper surface 170 of the clamping plate 120, e.g., by a distance $H_1$. The compression pad has a thickness $T_2$, wherein the pad channel 210 has a depth $D_1$. Thickness $T_2$ can be greater than the $D_1$, such that a portion of the compression pad 180 is raised above the upper surface 170 of the clamping plate 120, by the distance $H_1$.

As the waveguide plate 110 and the clamping plate 120 are secured together to enable formation of the waveguide manifold(s) (e.g., the sealed waveguide channel 138), the raised portion of the compression pad 180 causes a respective portion of the sealing layer 150 located at the opening of the waveguide channel 138 to be forced into the waveguide channel 138 (e.g., to a depth of about $H_2$, where $H_2 \approx H_1$, depending upon the resiliency of the material forming the compression pad 180 and the ductility of the sealing layer 150 material) thereby sealing off potential gap(s) that might occur at edges $P_1$ and $P_2$, wherein the edges $P_1$ and $P_2$ are formed at a respective perimeter of the opening of the waveguide channel 138. In the absence of the sealing layer 150, the edges $P_1$ and $P_2$ would equate to corners where the bottom surface 160 of the waveguide plate 110 is adjacent to (touching) the upper surface 170 of the clamping plate 120.

Successful operation of the sealing layer 150 with respect to sealing the edges $P_1$ and $P_2$ can be a function of the surface finish of the waveguide channel 138 and the bottom surface 160 of the waveguide plate 110. The respective surfaces can be machined (e.g., milled, polished) such that deformities/irregularities in the respective surface finishes, and vertical variance (e.g., warpage from machining stresses), are of such a magnitude that they can be successfully sealed by the deformation of the sealing layer 150. For example, fabrication of the waveguide plate 110 can result in deformities and/or vertical variance of a few thousandths of an inch (~0.001") per inch of travel.

Figure 2B:
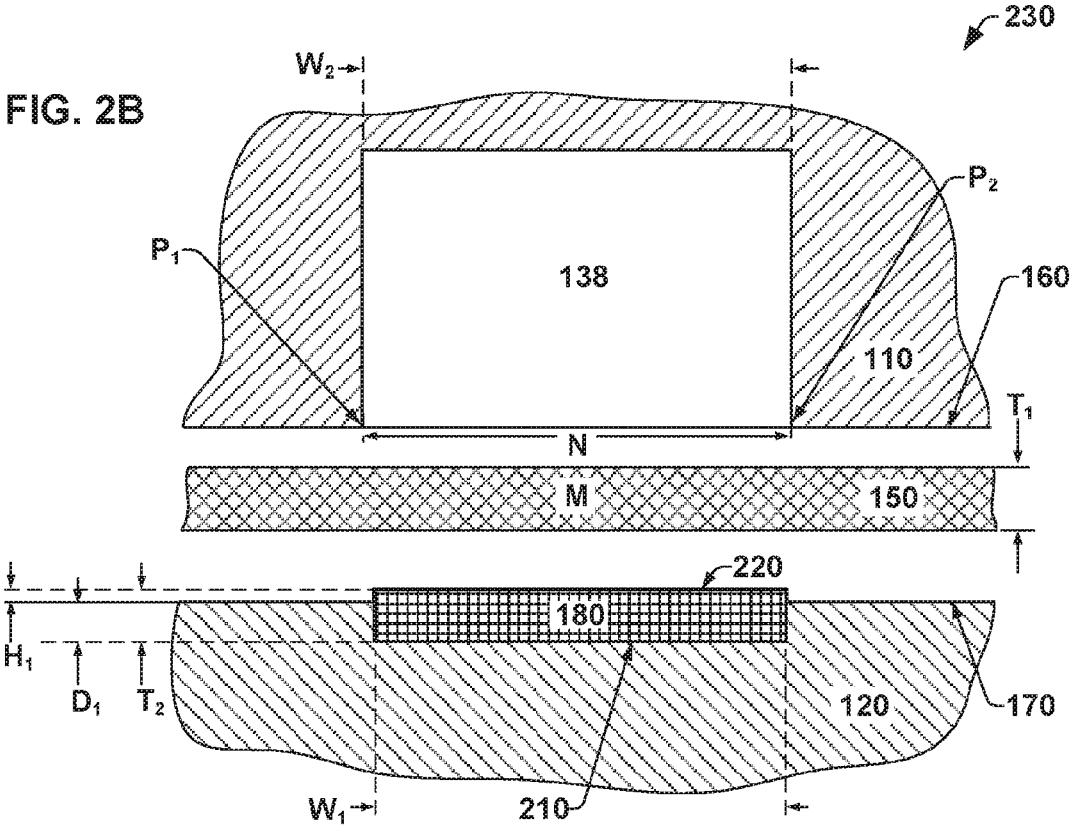
FIG. 2B presents a sectional view through various components prior to securing a waveguide plate with a clamping plate, according to an embodiment.

FIG. 2B, schematic 230, presents a view of the various components presented in FIG. 2A prior to assembly of the waveguide module 100. As is readily apparent, the sealing layer 150 is flat, and it is the clamping motion (vertical motion) of the compression pad 180 (per FIG. 2A) that pushes a portion M of the sealing layer 150 into the opening N (between edges $P_1$ and $P_2$) of the waveguide channel 138, resulting in the deformed configuration of the sealing layer 150 shown in FIG. 2A.

In an embodiment, the waveguide plate 110 and the clamping plate 120 can be respectively formed from any suitable material, e.g., having electrically conductive surface(s), such as an aluminum plate, a plate coated with a conductive material (e.g., silver plate), copper, aluminum alloy, copper alloy, polymer, etc.

In an embodiment, the sealing layer 150 can be formed from any material having a desired malleability (ductility) and an external surface (and core) that is electrically conductive, e.g., aluminum (e.g., commercially pure (≥99%) annealed aluminum), copper, an alloy of aluminum, an alloy of copper, a clad sheet (e.g., copper clad sheet, a silver coated sheet, etc.), a plated sheet (e.g., a sheet comprising a conductive external layer(s) and an organic core), polymer etc.

The compression pad 180 can be formed from a material having a desired resilience and/or hardness such that during securing of the waveguide plate 110 and the clamping plate 120, the compression pad 180 has sufficient integrity to cause the sealing layer 150 to deform. In an embodiment, the compression pad 180 can be formed from a material that applies a desired pressure to the sealing layer 150 such that the sealing layer 150 is deformed to a desired amount to facilitate sealing of the waveguide 138 (e.g., positions $P_1$ and $P_2$, as previously described), without causing the sealing layer 150 to split (rupture, tear, crack, etc.). Hence, any suitable material for the compression pad 180 can be utilized, wherein the material has a desired compression set (e.g., a relatively low compression set) while applying a desired force upon the sealing layer 150. In an embodiment, the compression pad 180 can be formed from a silicone rubber (e.g., a pad), wherein during securing of the waveguide plate 110 and the clamping plate 120, the silicone rubber applies a pressure of 100 pounds per square inch (psi) to the sealing layer 150. A benefit of using a material with an inherent degree of elasticity is that relaxation may occur in one or more components and/or materials forming the waveguide module 100 is compensated for by expansion of the elastic material, thereby enabling pressure to be continually applied by the compression pad to the sealing layer. For example, the selected material can apply a uniform compression force upon the sealing layer 150 over time, e.g., during securing of the waveguide plate 110 and the clamping plate 120, and any time thereafter, such as during operation of the waveguide module 100. In an exemplary embodiment, the compression pad 180 can have a thickness of about 1/16", with a durometer value of about 30 A to 70 A, wherein compression of the compression pad 180 to 50% thickness (e.g., about 1/32") yields approximately 100 psi force exerted by the compression pad 180 upon the sealing layer 150. When utilizing a stiffer material, e.g., higher value durometer, a compression pad 180 of greater thickness can be used such that small a deviation in mechanical dimensions does not translate to high deviates of mechanical preload forces.

As previously mentioned, the compression pad 180, having a thickness $T_2$, can be located in the channel 210, wherein the channel 210 has a depth $D_1$. The thickness $T_2$ can be greater than the $D_1$, such that a portion of the compression pad 180 is raised above the upper surface 170 of the clamping plate 120.

Figure 3A:
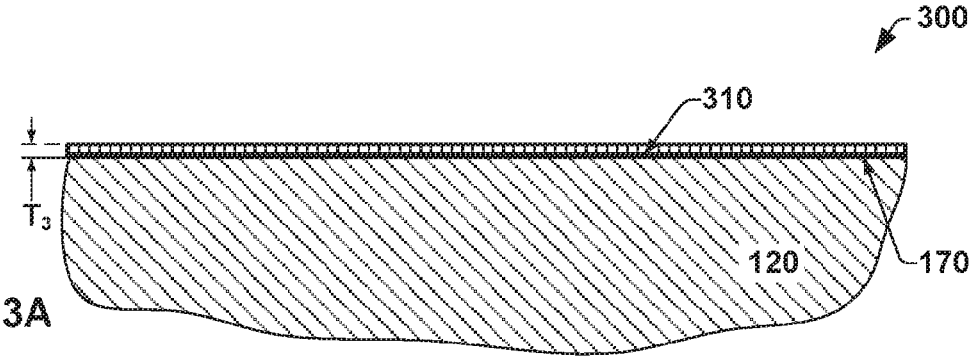
FIG. 3A illustrates fabrication of a deposited material layer to form a compression pad, according to an embodiment.
Figure 3B:
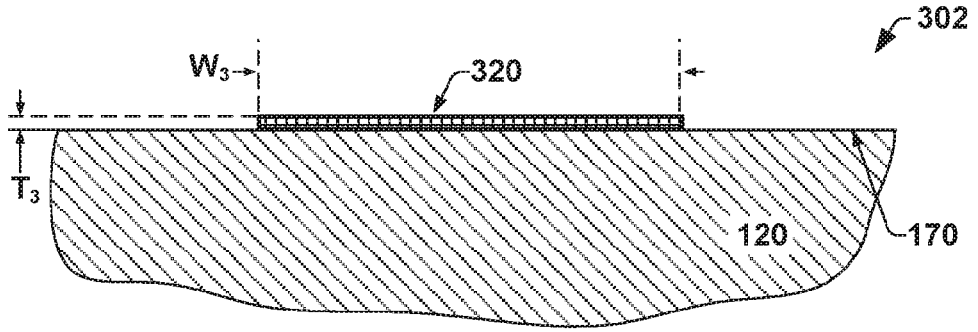
FIG. 3B illustrates fabrication of a deposited material layer to form a compression pad, according to an embodiment.

In another embodiment, a compression pad can be formed by fabricating raised portions of material on the upper surface of the clamping plate 120. FIGS. 3A and 3B, respectively illustrate schematics 300 and 302, wherein FIG. 3A presents a layer 310 which has been deposited upon the upper surface 170 of the clamping plate 120. Per FIG. 3B, the layer 310 can undergo a material removal process (e.g., machining, etching, polishing, etc.) to form a raised material layer 320 as required to facilitate sealing of a waveguide channel fabricated in the waveguide plate 110 (as previously described with reference to FIGS. 1 and 2A). The raised material layer 320 can be processed such that the portions of raised material layer 320 have a thickness $T_3$, (e.g., similar to height $H_1$ of FIG. 2A) to facilitate functionality of the portions of raised material layer 320 similar to that of the compression pad 180, as previously described. Further, the raised material layer 320 can have a width $W_3$, wherein the width $W_3$ is less than the width of the waveguide channel 138 to facilitate ingress of a portion of the sealing layer 150 into the opening of the waveguide channel 138 (e.g., between edges $P_1$ and $P_2$) to seal irregularities, etc., at the edges $P_1$ and $P_2$ during attachment of the waveguide channel plate 110 to the clamping plate 120. Deposition of the layer 310 (subsequently forming the portions of raised material layer 320) can be by any suitable material deposition technology, e.g., plasma spraying, foam spraying, polymer deposition, etc.

Figure 3C:
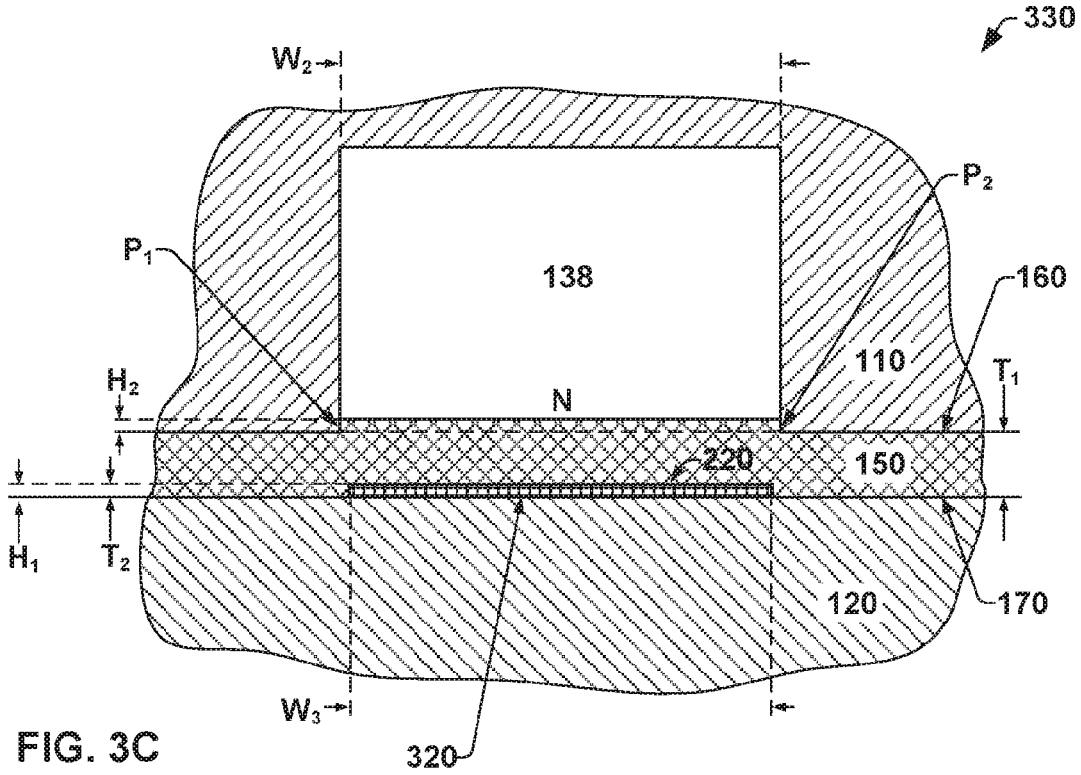
FIG. 3C illustrates a waveguide channel being sealed by a sealing layer in conjunction with a compression pad formed from a deposited layer, according to an embodiment.

FIG. 3C, schematic 330, illustrates the raised material layer 320 forcing a portion of the sealing layer 150 into the opening N of the waveguide channel 138 to facilitate sealing of discontinuities, etc., at the edges $P_1$ and $P_2$, as previously described.

Figure 4:
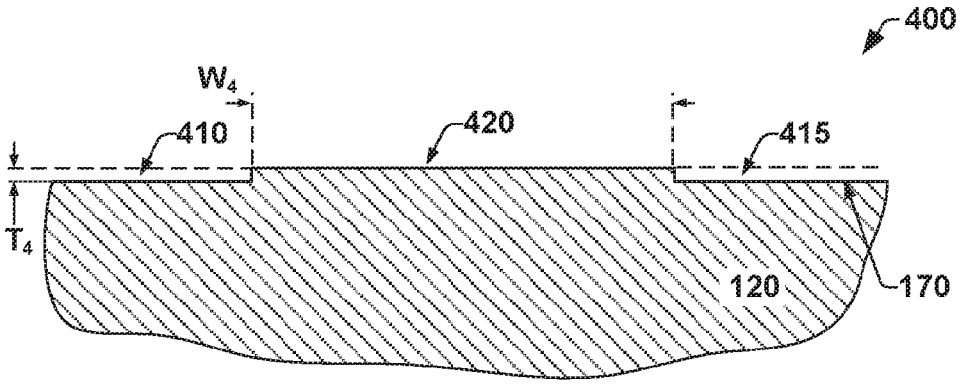
FIG. 4 illustrates a compression pad formed from a raised portion of material on a surface of a clamping plate.

In a further embodiment, raised portions can be formed by machining the upper surface 170 of the clamping plate 120. As shown in FIG. 4, configuration 400, unwanted (undesired) regions of material 410 and 415 can be removed (e.g., milled) such that a desired portion(s) of material 420 remains, wherein the material portion 420 has a height $T_4$ (e.g., similar to height $H_1$ of FIG. 2A) and a width $W_4$, and hence the material portion 420 can function in similar manner to that of the raised portion of the compression pad 180 with regard to deforming the sealing layer 150 during securing of the waveguide plate 110 and the clamping plate 120, as previously described.

Selection of whether to utilize a configuration comprising a compression pad 180, a configuration comprising a raised material layer 320 formed on a clamping plate 120, or a configuration comprising a raised material layer 420 formed on a clamping plate 120, can be based in part upon a signal frequency at which the waveguide is to operate at, e.g., K-, Ku-, Ka-, X-, L-, C-band, etc. Each particular frequency of operation has an associated standard waveguide width and height. For example, at Ka-band (26.5-40 GHz), the waveguide dimensions are about 0.28× about 0.14 inches (approx. 7×3.5 mm), while at C-band (5.85-8.20 GHz) the waveguide dimensions are about 1.37× about 0.622 inches (approx. 35×16 mm). Hence, any of the compression pad 180, the raised material layer 320, or the raised material layer 420 may be amenable for application at C band frequencies, while the compression pad 180 and pad channel 210 may be more desirable for application at Ka-band frequencies.

For an understanding of the relationship between thickness $T_1$ of the sealing layer 150 versus the width $W_2$ of the waveguide channel 138, in an exemplary embodiment for a Ka-band waveguide module design, the thickness $T_1$ of the sealing layer 150 can be 0.032", which is approximately 11% of the waveguide width $W_2$ (0.032"/0.280"=11.4%). It is to be appreciated that the stated value of $T_1$ is for exemplary purposes only, and any values of $T_1$ and $W_2$, and corresponding ratios, can be utilized in accordance with the various embodiments presented herein.

Figure 5:
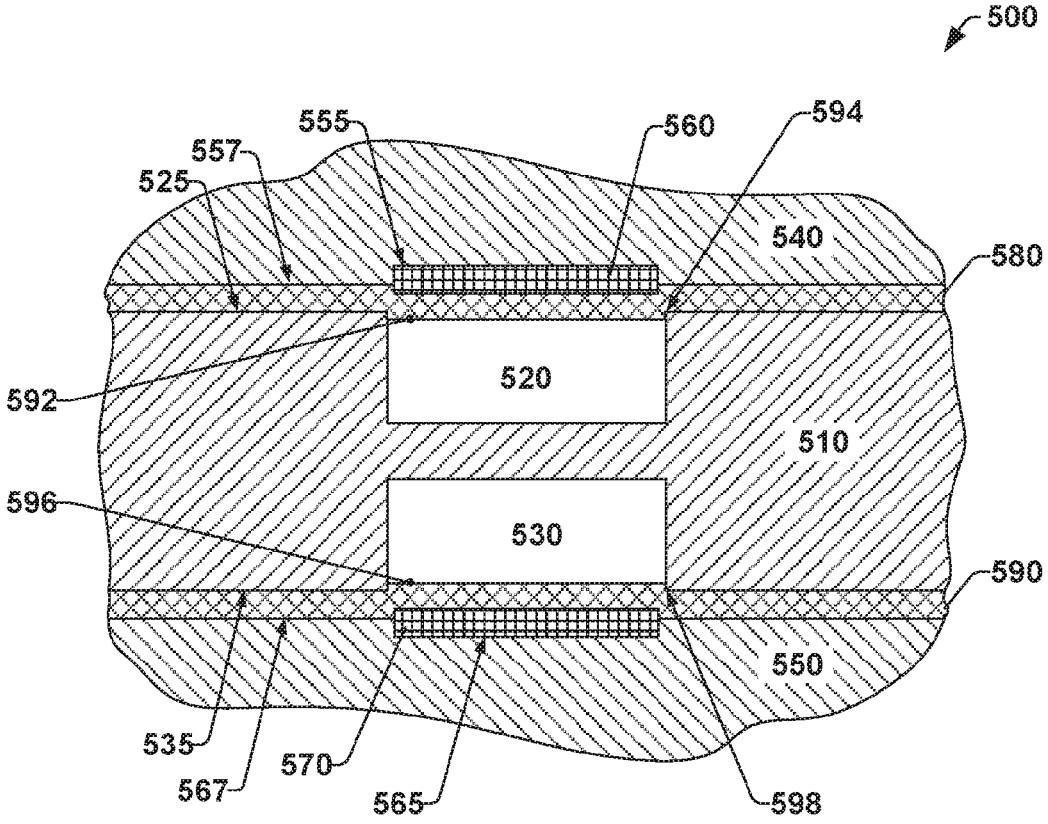
FIG. 5 illustrates a waveguide module comprising a waveguide plate having waveguides formed on upper and lower surfaces of the waveguide plate, according to an embodiment.

As further shown in FIG. 5, a waveguide plate can be configured with waveguides formed on both the upper and lower surfaces of the waveguide plate. The waveguide module 500 comprises a waveguide plate 510 having a first waveguide channel 520 fabricated into an upper surface 525 of the waveguide plate 510, and a second waveguide channel 530 fabricated into a lower surface 535 of the waveguide plate 510. Respectively located on either side of the waveguide plate 510 is a first clamping plate 540 and a second clamping plate 550. A first pad channel 555 has been machined into a lower surface 557 of the first clamping plate 540, with a first compression pad 560 located therein. A second pad channel 565 has been machined into an upper surface 567 of the second clamping plate 550, with a second compression pad 570 located therein. Sandwiched between the upper surface 525 of the waveguide plate 510 and the lower surface 557 in conjunction with the first compression pad 560 is a first sealing layer 580. Further, sandwiched between the lower surface 535 of the waveguide plate 510 and the upper surface 567 in conjunction with the second compression pad 570 is a second sealing layer 590. As previously described, as the waveguide module 500 is being assembled, e.g., the first clamping plate 540 and the second clamping plate 550 are respectively secured to the waveguide plate 510, the first compression pad 560 causes a first portion 592 of the sealing layer 580 to ingress into the first waveguide channel 520 such that incongruities, warping, etc., at an edge 594 of the first waveguide channel 520 are sealed by deformation of the sealing layer 580 at the edge 594 region. Further, the second compression pad 570 causes a second portion 596 of the sealing layer 590 to ingress into the second waveguide channel 530 such that incongruities, warping, etc., at an edge 598 of the second waveguide channel 530 are sealed by deformation of the sealing layer 590 at the region of the edge 598. It is to be appreciated that while the first waveguide channel 520 and the second waveguide channel 530 are illustrated in FIG. 5 as being located opposite from each other, the waveguide channels 520 and 530 can be positioned with a respective horizontal offset from each other.

Figure 6:
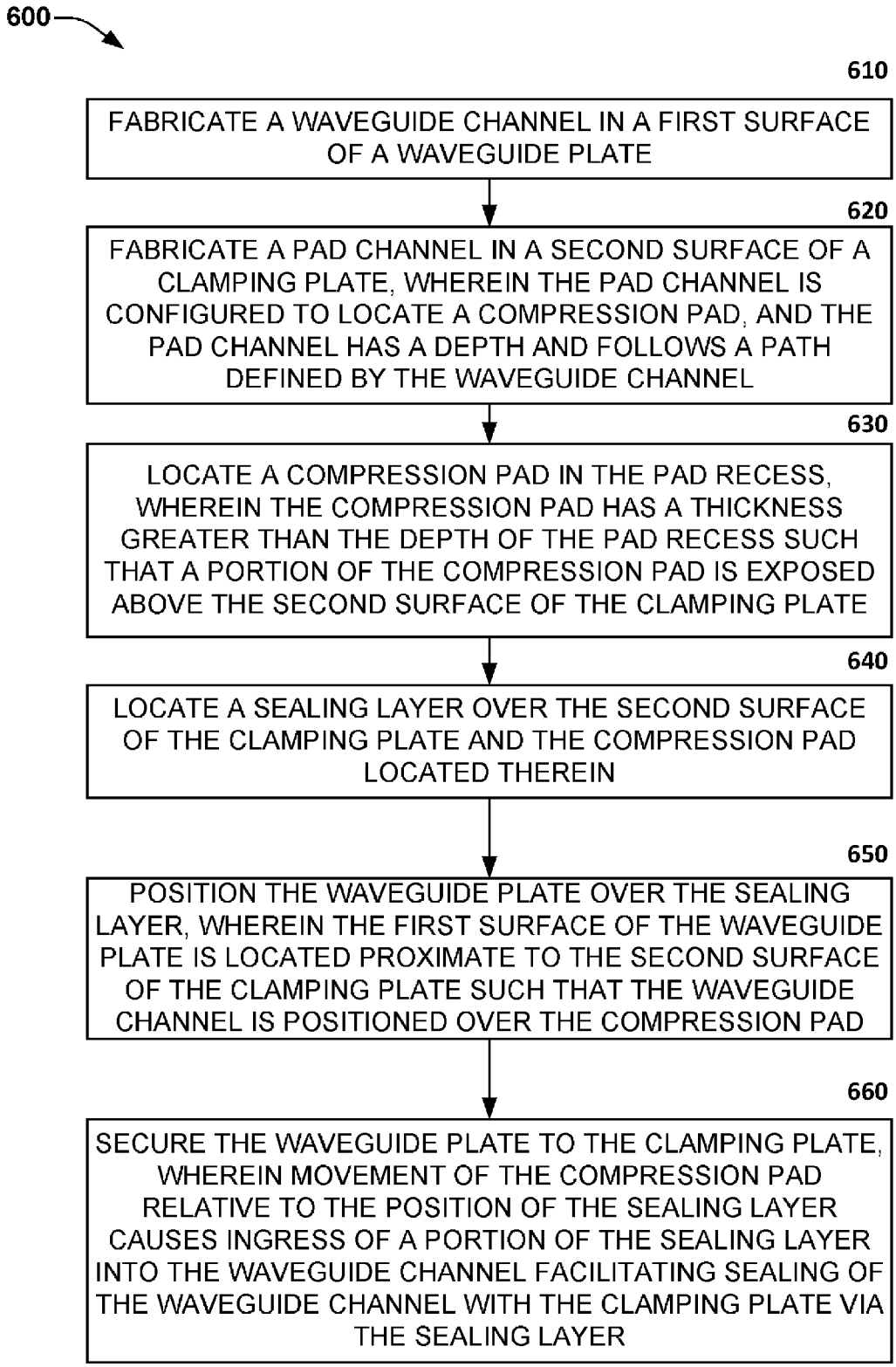
FIG. 6 is a flow diagram illustrating an exemplary methodology for forming a waveguide module comprising a sealing layer and a compression pad.
Figure 7:
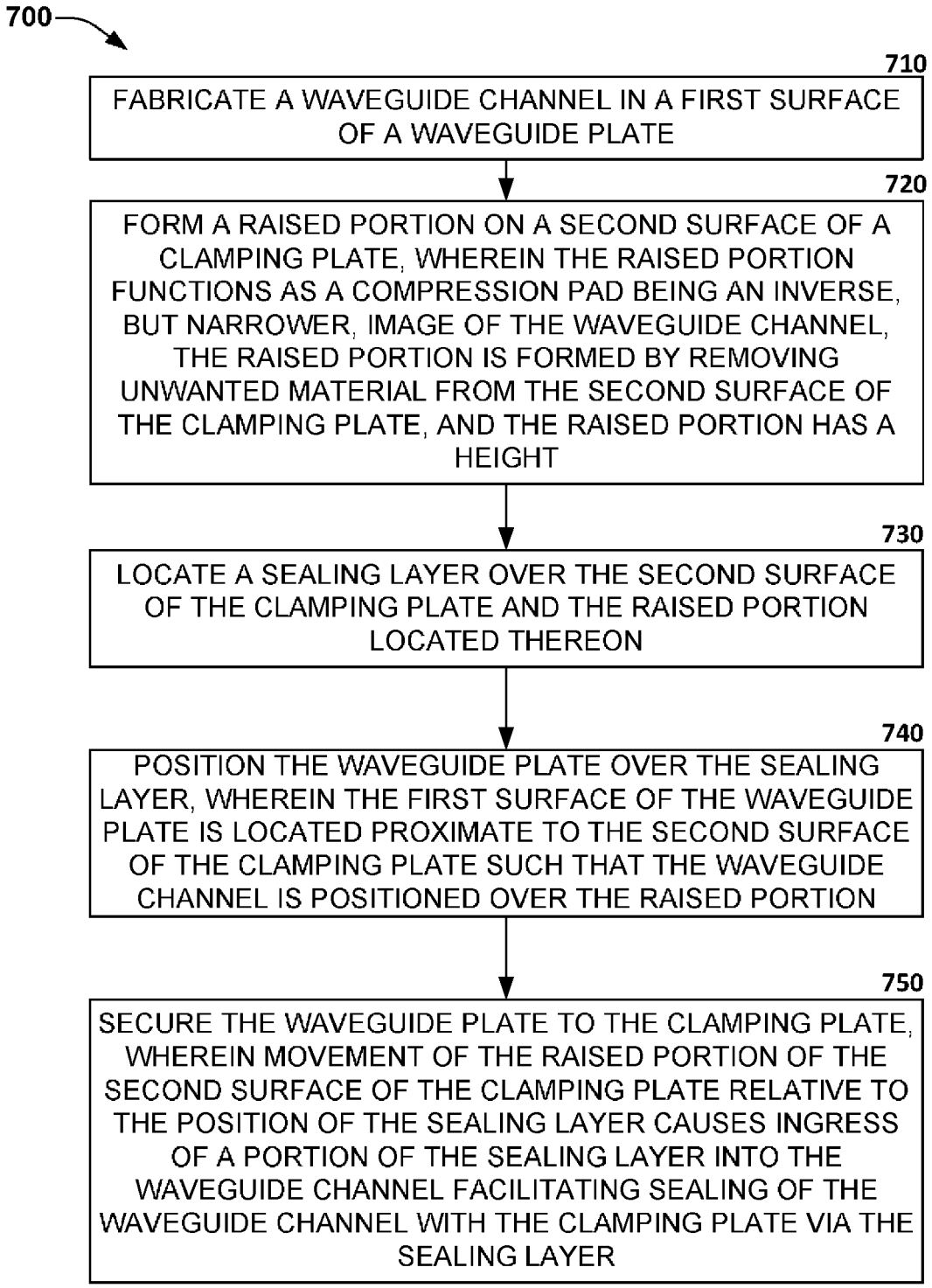
FIG. 7 is a flow diagram illustrating an exemplary methodology for forming a waveguide module comprising a sealing layer and a compression pad formed from a raised portion fabricated in a surface of a clamping plate.

FIGS. 6 and 7 are methodologies relating to sealing an edge of a waveguide channel opening to facilitate operation of a waveguide module with a desired electromagnetic modality. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement the methodologies described herein.

FIG. 6 presents a methodology 600 for utilizing a compression pad to effect sealing of an edge of a waveguide channel with a sealing layer located between a waveguide plate having the waveguide channel formed therein and a clamping plate. At 610, a waveguide channel is fabricated into a first surface of a waveguide plate. The waveguide channel can have a trough-like configuration which opens to the first surface of the first plate, wherein the opening of the waveguide channel forms an edge at a junction with the first surface.

At 620, a pad channel is fabricated into a second surface of a clamping plate, wherein the pad channel is configured to locate a compression pad. The pad channel has a depth $D_1$, and when the first surface of the waveguide plate is placed adjacent to the second surface of the clamping plate, the pad channel is an inverse image of the waveguide channel and can follow a path defined by the waveguide channel in the first surface of the waveguide plate, although the pad channel can have a width narrower than the waveguide channel, per the relationship between $W_1$ and $W_2$, as previously described.

At 630, a compression pad is located in the pad channel. The compression pad has a thickness $T_2$ that is greater than the depth $D_1$ of the pad channel such that a portion (having a height $H_1$) of the compression pad is exposed (raised) above the second surface of the clamping plate.

At 640, a sealing layer is located over the clamping plate, such that a lower surface of the sealing layer is positioned against the second surface of the clamping plate and the compression pad located therein. As previously described, the sealing layer is formed from a malleable material.

At 650, the first surface of the waveguide plate waveguide plate is positioned on an upper surface of the sealing layer, wherein the first surface of the waveguide plate is proximate to the second surface of the clamping plate, with the sealing layer located therebetween, such that the waveguide channel is located over the compression pad (e.g., the waveguide channel is registered to the compression pad).

At 660, the waveguide module is assembled such that the waveguide plate is secured to the clamping plate (e.g., via a fastener located in a through-hole in the waveguide plate and the clamping plate). During the securing operation, the compression pad forces a portion of the sealing layer into the waveguide channel opening enabling sealing of the edge of the waveguide channel opening with the second surface of the clamping plate via the sealing layer located therebetween. Deformation of the sealing layer causes material in the sealing layer to fill gaps, irregularities, etc., which may be present at the edge of the waveguide channel opening (e.g., as a function of the fabrication operation utilized to form the waveguide channel). As previously mentioned, the compression pad has a width $W_1$ that is less than the width $W_2$ of the waveguide channel, enabling a portion of the sealing layer to be pushed into the waveguide channel opening.

FIG. 7 presents a methodology 700 for utilizing a raised layer (compression layer) to effect sealing of an edge of a waveguide channel with a sealing layer located between a waveguide plate having the waveguide channel formed therein and a clamping plate. At 710, a waveguide channel is fabricated into a first surface of a waveguide plate. The waveguide channel can have a trough-like configuration which opens to the first surface of the first plate, wherein the opening of the waveguide channel forms an edge at a junction with the first surface.

At 720, a raised portion is formed on a second surface of a clamping plate, wherein the raised portion functions as a compression pad (as previously described). The raised portion is formed by removing unwanted material from the second surface of the clamping plate to leave the raised portion, wherein the raised portion has a height $H_1$. The raised portion is configured to be an inverse image of the waveguide channel when the first surface of the waveguide plate is placed adjacent to the second surface of the clamping plate, and can follow a path defined by the waveguide channel in the first surface of the waveguide plate, although the raised portion can have a width narrower than the waveguide channel, per the relationship between $W_1$ and $W_2$, as previously described.

At 730, a sealing layer is located over the clamping plate, such that a lower surface of the sealing layer is positioned against the second surface of the clamping plate and the raised portion located thereon. As previously described, the sealing layer is formed from a malleable material.

At 740, the first surface of the waveguide plate waveguide plate is positioned on an upper surface of the sealing layer, wherein the first surface of the waveguide plate is proximate to the second surface of the clamping plate, with the sealing layer located therebetween, such that the waveguide channel is located over the raised portion (e.g., the waveguide channel is registered to the raised portion).

At 750, the waveguide module is assembled such that the waveguide plate is secured to the clamping plate (e.g., via a fastener located in a through-hole in the waveguide plate and the clamping plate). During the securing operation, the raised portion of the second surface of the clamping plate forces a portion of the sealing layer into the waveguide channel opening enabling sealing of the edge of the waveguide channel opening with the second surface of the clamping plate, via the sealing layer located therebetween. Deformation of the sealing layer causes material in the sealing layer to fill gaps, irregularities, etc., which may be present at the edge of the waveguide channel opening (e.g., as a function of the fabrication operation utilized to form the waveguide channel). As previously mentioned, the raised portion has a width $W_4$ that is less than the width $W_2$ of the waveguide channel, enabling a portion of the sealing layer to be pushed into the waveguide channel opening by the raised portion.

For conciseness, it is to be appreciated that methodology 700 can also utilize a raised portion that has been formed from a layer deposited upon the clamping plate (e.g., as described in FIG. 3). Hence, methodology 700 can also be read with the raised portion being replaced by a layer portion that has been formed (e.g., machined) from a layer deposited upon the second surface of the clamping plate. The deposited layer can also be constrained during deposition, e.g., by a template or mask, to facilitate exact, or near-net-shape forming.

The various embodiments herein also have an environmental advantage over conventional waveguide manifolds. In an embodiment where the waveguide plate is formed from aluminum, the majority of waste is aluminum trimmings that can be recycled. Standard waveguide manufacturing may require greater energy consumption and may produce a greater amount of waste, including toxicity from the brazing process utilized to join waveguide pipes.

Per the various embodiments presented herein, it is readily apparent that CNC machining, or other suitable fabrication process, is amenable to fabrication of complex waveguides and networks with a high degree of precision and accuracy, enabling accurate phase tolerancing of a waveguide module in comparison with the constraints, both manufacturing and operational, inherent with utilizing waveguide manifolds fabricated from tube structures.

What has been described above includes examples of one or more embodiments. It is, of course, not possible to describe every conceivable modification and alteration of the above structures or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A waveguide module comprising:

a first plate, the first plate comprises a waveguide channel, the waveguide channel is a trough with an opening at a first surface of the first plate forming an edge with the first surface;

a second plate, the second plate has a raised portion formed on a second surface of the second plate, the raised portion comprising a metal, the raised portion follows a path defined by the waveguide channel when the first surface of the first plate is located adjacent to the second surface of the second plate, and the raised portion has a first height; and a sealing layer located between the first plate and the second plate, the sealing layer having an upper surface and a lower surface, the sealing layer upper surface is located adjacent to the first surface of the first plate and the waveguide channel opening, the sealing layer lower surface is located adjacent to the second surface of the second plate and the raised portion, wherein the raised portion deforms a first portion of the sealing layer such that the first portion of the sealing layer is forced into the opening of the waveguide channel sealing a discontinuity between the edge of the waveguide channel opening and the second surface of the second plate.

2. The waveguide module of claim 1, wherein the second plate comprises one of aluminum, an aluminum alloy, copper, a copper alloy, a polymer, or a plate material having an electrically conductive layer formed thereon.

3. The waveguide module of claim 1, wherein the first plate comprises aluminum, an aluminum alloy, copper, a copper alloy, a polymer, or a plate material having an electrically conductive layer formed thereon.

4. The waveguide module of claim 1, wherein the sealing layer comprises aluminum, an aluminum alloy, copper, a copper alloy, a polymer, an electrically conductive material, or a sheet of material having an electrically conductive surface layer formed thereon.

5. The waveguide module of claim 1, wherein the raised portion comprises a material layer deposited upon the second surface of the second plate, wherein a portion of the deposited material is removed from the second surface of the clamping plate to form the raised portion.

6. The waveguide module of claim 1, wherein the raised portion has a configuration formed by removal of metal from the second surface of the second plate.

7. A method for forming a waveguide module, the method comprising:

forming a waveguide channel in a first surface of a waveguide plate, wherein the waveguide channel is a trough with an opening at the first surface, with an edge formed at a junction of a perimeter of the opening and the first surface;

forming a raised portion on a second surface of a clamping plate, the raised portion comprising a same material as the clamping plate, wherein the raised portion follows a path defined by the waveguide channel in the first surface of the waveguide plate when the first surface of the waveguide plate is located adjacent to the second surface of the clamping plate, and the raised portion has a first height;

positioning the waveguide plate on the clamping plate, wherein a sealing layer is located between the first surface of the waveguide channel and the second surface of the clamping plate and the raised portion located thereon; and securing the waveguide plate to the clamping plate, wherein vertical motion of the raised portion forces a portion of the sealing layer into the waveguide channel opening to seal a discontinuity between the edge of the waveguide channel opening and the second surface of the clamping plate.

8. The method of claim 7, wherein the waveguide plate comprises aluminum, an aluminum alloy, copper, a copper alloy, a polymer, or a plate material having an electrically conductive layer formed thereon.

9. The method of claim 7, wherein the waveguide channel is formed by a milling process.

10. The method of claim 7, wherein the sealing layer is one of aluminum, an aluminum alloy, copper, a copper alloy, a polymer, an electrically conductive material, or a sheet of material having an electrically conductive surface layer formed thereon.

11. The method of claim 7, wherein the clamping plate comprises one of aluminum, an aluminum alloy, copper, a copper alloy, a polymer, or a plate material having an electrically conductive layer formed thereon.

* * * * *